United States Patent [19]

Azar

[11] Patent Number: 4,674,299

[45] Date of Patent: Jun. 23, 1987

[54] BRACELET CONSTRUCTION HAVING REPLACEABLE ORNAMENTS

[76] Inventor: Patricia A. Azar, R.F.D. #121, Great Rd., Lincoln, R.I. 02865

[21] Appl. No.: 809,280

[22] Filed: Dec. 16, 1985

[51] Int. Cl.[4] ..... A44C 5/00

[52] U.S. Cl. ..... 63/7; D11/5

[58] Field of Search ..... 224/164, 165; 63/7, 63/3; D11/4, 5

[56] References Cited

U.S. PATENT DOCUMENTS

| | | | |
|---|---|---|---|
| 236,552 | 1/1881 | Codding | 63/7 |
| 1,935,504 | 11/1933 | Hargreaves | 63/3 |
| 2,164,197 | 6/1939 | Beaupre | 63/7 |
| 2,180,980 | 11/1939 | Fassnacht | 63/7 |
| 2,522,852 | 9/1950 | Apps | 63/7 |

FOREIGN PATENT DOCUMENTS

| | | | |
|---|---|---|---|
| 466988 | 6/1937 | United Kingdom | 63/7 |

*Primary Examiner*—Richard J. Johnson
*Attorney, Agent, or Firm*—Salter & Michaelson

[57] ABSTRACT

A bracelet construction including a pair of arms that are hingedly connected at one end thereof, the bracelet arms being formed in curved configurations that provide for placement of the bracelet on the wrist of a wearer, each bracelet arm removably receiving an ornamental element and each of the ornamental elements being provided with a tab at an end thereof that is insertable into a slot in the corresponding end of the arm on which it is received, the other end of each ornamental element having an opening formed therein, the opening receiving a pin or projection that is formed as part of a hinge assembly that interconnects the arms, the arrangement of the pin and slot providing for replacement of the ornamental elements with ornamental elements of similar configurations but different colorations.

3 Claims, 4 Drawing Figures

BRACELET CONSTRUCTION HAVING REPLACEABLE ORNAMENTS

BACKGROUND OF THE INVENTION

The present invention relates to a bracelet construction that is comprised of a pair of pivotally connected arms in which replaceable ornamental inserts or elements are mounted. More particularly, the present invention relates to a bracelet construction having curved bracelet arms that are pivotally connected, each of the arms being provided with means by which replaceable ornamental elements are conveniently inserted into the arms and are easily removed therefrom for replacement by similar elements of different coloration.

Prior to the instant invention, some bracelets and other jewelry-type articles such as earrings have been constructed heretofore with replaceable or interchangeable ornaments. Generally, such bracelet or jewelry-type constructions have provided for the interchangeability of an ornamental article by some form of attachment that enabled the ornament to be removed and a replaceable or substitute ornament inserted in place thereof. However, such bracelets and other jewelry articles having interchangeable ornaments and the like have been relativley complex in construction and in many instances have not provided for the secure attachment of the ornament in the assembly. Further, the prior known interchangeable ornaments as utilized in jewelry articles have not always succeeded in disguising the replaceable characteristics of the ornaments, and as a result have not always found favor with the customer.

Applicant is aware of certain prior known bracelet constructions having pivotally mounted bracelet arms on which ornamental elements were fixed, but such constructions did not provide for the interchangeability of the ornamental elements that were secured to the arms with other ornamental elements of similar construction but different coloration.

Other prior art of which applicant is aware are the U.S. Pat. Nos. to GEEHARDT, 649,108; VANCE, SR., 756,041; HARGREAVES, 1,935,504; HERMAN, 2,457,672; TUCKER, SR., 2,733,578; EBERT, 2,769,747; FRIEDMAN, 3,470,638 and HILL, 3,521,798; and the British Patent No. to LOACH et al, 230,986.

The purpose of the present invention is to overcome the problems that have been experienced heretofore with bracelets having replaceable ornaments and to further provide such a construction at a relatively inexpensive cost.

SUMMARY OF THE INVENTION

The present invention relates to a bracelet construction that includes a pair of arms having a curved configuration that generally conforms to the wrist of the wearer. A hinge assemlby is joined to an end of each arm for interconnecting the arms in pivotal relation, and an ornamental element is removably mounted on each arm. Each of said ornamental elements has a shape and configuration corresponding to the arm on which it is mounted and has a designated coloration for complimenting the color of accessories as worn by the wearer. An opening is formed in each ornamental element adjacent to an end thereof, and a projecting tab is formed on each ornamental element at the other end thereof. A pin is located on the hinge assembly, and is received in the opening of an ornamental element for locating said end thereof on an arm of the bracelet. A recess is formed in each arm on the end thereof opposite to the hinged end for receiving said tab therein for removably mounting said other end of the ornamental element on the arm.

Accordingly, it is an object of the present invention to provide a bracelet construction having pivotally connected arms on which ornamental elements are removably mounted and that are easily and simply disconnected from the assembly for replacement with a similar ornamental element of different coloration.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

Figure 1:
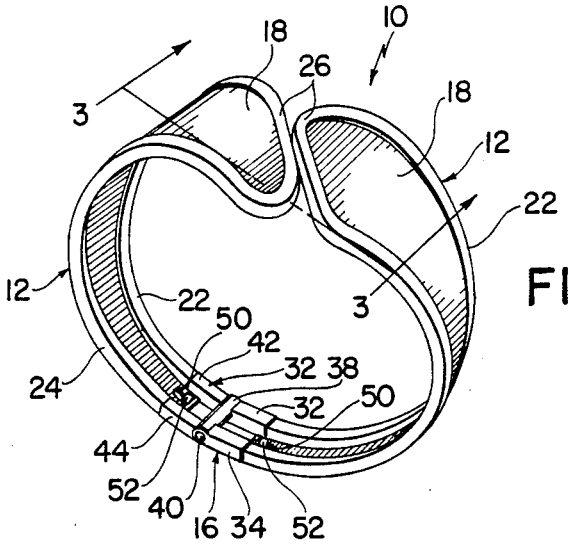
FIG. 1 is a perspective view of the bracelet construction as embodied in the subject invention.
Figure 3:
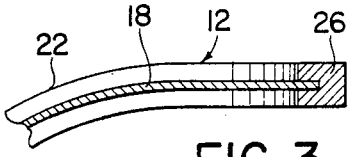
FIG. 3 is a sectional view taken along line 3—3, in FIG. 1.

Referring now to the drawing and more particularly to FIG. 1, the bracelet construction as embodied in the present invention is illustrated and is generally indicated at 10. The bracelet construction 10 includes a pair of bracelet arms generally indicated at 12 that are identically formed and that are interconnected at an end thereof by a hinge assembly generally indicated at 16. The arms 12 have a curved configuration and compliment each other to provide for the mounting of the bracelet construction 10 on the wrist of the wearer upon separation of the arms by pulling them outwardly at the free ends thereof to effect a hinging action at the connection to the hinge assembly 16. As further illustrated in FIG. 1, each of the arms 12 has an ornamental element 18 inserted therein, the ornamental elements 18 being removably mounted in place on the arms 12 as will hereinafter be described.

Figure 2:
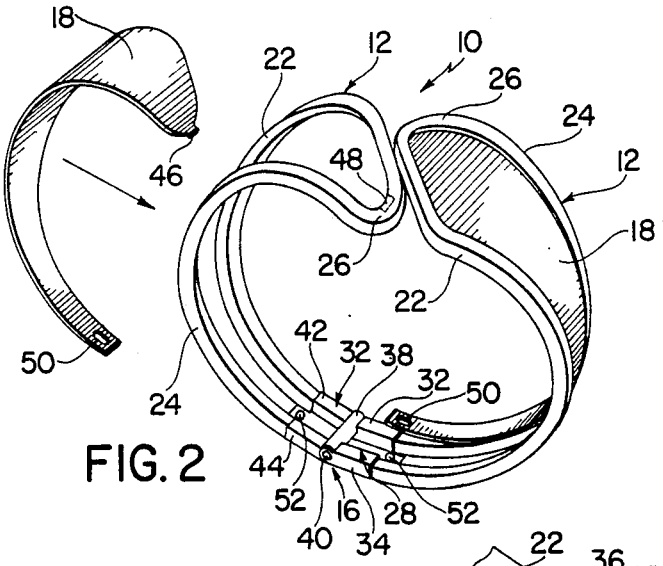
FIG. 2 is a view similar to FIG. 1 and showing in exploded form the manner in which a replaceable ornamental element is inserted into position on an arm of the bracelet construction.
Figure 4:
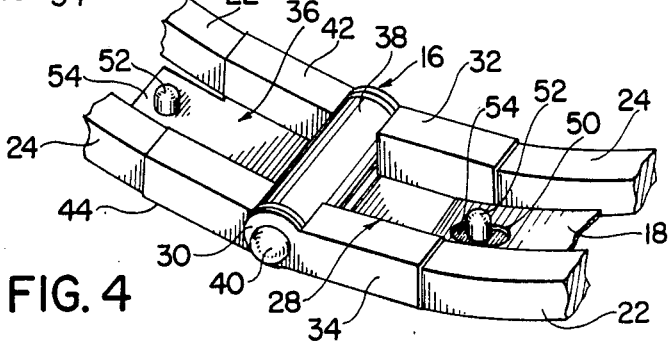
FIG. 4 is an enlarged perspective view of the hinge assembly that interconnects the bracelet arms and illustrates the mounting of an end of an ornamental element on a projecting pin that is fixed to said hinge assembly.

As illustrated in FIG. 2, each of the bracelet arms 12 is formed in a continuous length of material preferably of a plated metal in a generally "U"-shaped configuration that defines spaced-apart rails 22 and 24 that are interconnected at the head end thereof by a connecting portion 26 to form a space for receiving an ornamental element 18, the rails 22 and 24 terminating at free ends thereof opposite to the connecting portion 26 for securement to the hinge assembly 16. As illustrated more clearly in FIG. 4, the hinge assembly 16 includes a first hinge member generally indicated at 28 which includes a hinge knuckle 30 to which are joined spaced legs 32 and 34. A second hinge member 32 generally indicated at 36 includes a hinge knuckle 38 that is pivotally connected to the hinge knuckle 30 of first hinge member 28 by a pintle 40. Formed on the second hinge member 36 are spaced apart legs 42 and 44 into which the free ends of the rails 22 and 24 of the corresponding bracelet arm 12 are securely received. Similarly, the legs 32 and 34 of the other hinge member 28 receives the free ends of the rails 22 and 24 of the corresponding bracelet arm 12 therein in secured relation. It is seen that the arms 12 are pivotally movable relative to each other by means of the hinge assembly 16 to move the normally abutting connecting portions 26 of the arms 12 apart from each other in separated relation to enable the bracelet construction to be inserted over the wrist of the wearer. Since the hinge assembly 16 also includes a spring member (not shown) that interconnects the hinge knuckles 30 and 34, the arms 12 are normally located in abutting relation at the connection portions thereof in the closed position, as illustrated in FIGS. 1 and 2, and are separated against the action of the spring for placement of the bracelet construction 10 on the arm of the wearer.

The unique concept embodied in applicant's novel bracelet construction resides in the replacement of the ornamental elements 18 with similar ornamental elements of different hues and colorations. As more clearly shown in FIG. 2, each of the ornamental elements 18 is formed in a curved configuration that generally corresponds to the configuration of the arms 12. Preferably, the ornamental elements 18 are formed of a thin lightweight flexible metal material that enables the element to be flexed for insertion into the space as formed between the rails 22 and 24 of the arm in which it is to be inserted. The surfaces of the ornamental elements are preferably enameled in selected colors to a high gloss finish, although other techniques can be utilized to color the ornamental elements without departing from the spirit of the invention. In order to mount an ornamental element 18 in place, an outwardly projecting tab 46 is joined to the end thereof that fits within the rails at the connecting portion 26 and is received within a recess 48 as formed in the interior wall of the connecting portion 26 of the arm. Formed in the opposite end of the ornamental element is a slot 50 that is received on an upstanding pin 52 that is formed on an extension 54 located between the legs of the hinge assemblies 28 and 36.

In order to replace the ornamental elements 18 as mounted in a bracelet arm 12 between the rails thereof, it is only necessary to flex the end of the ornamental element forwardly and upwardly in which the slot 50 is formed, the relative movement of the element with respect to the pin allowing the slot to clear the pin 52 that extends therethrough. The tab 46 can then be retracted from its recess 48 as formed in the connection portion 48 by further flexing of the element rearwardly, and the ornamental element is then free for removal from the bracelet arm 12. A similar ornamental element of different coloration or having any suitable design imprinted thereon is then inserted between the rails of a bracelet arm 12 arm by first locating the slot 50 over the pin 52 and then inserting the tab 46 into the recess 48 as formed in the head portion 26 of the bracelet arm. Replacement ornamental elements 18 are mounted on both arms in identical fashion, and the replacement ornamental elements now impart a separate and distinct appearance for the bracelet construction because of the different coloration applied thereto. It is seen that the thin material from which the ornamental elements are formed provides for the flexing movement thereof and enables the ornamental elements to be easily mounted between the rails of the arms and removed therefrom.

As described hereinabove, each of the bracelet arms 12 is identically formed in shape and configuration which enables the ornamental elements 18 to be mounted thereon without regard to orientation. Thus, each ornamental element 18 can be mounted on either of the arms 12, because of the identity of construction of the arms. The mounting of the ornamental elements 18 between the rails of the arms is simple to effect; and once the ornamental elements are mounted in place, they impart a finished appearance to the bracelet construction. If desired, the bracelet construction can be utilized without placement of the ornamental elements 18 between the rails of the arms 12, but the wearer does have the option of inserting a different colored ornamental element 18 on an arm 12 as desired, depending upon the fashion accessories as worn by the wearer.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A bracelet construction comprising a pair of arms having a curved configuration that generally conform to the wrist of the wearer, a hinge assembly joined to an end of each arm for interconnecting said arms in pivotal relation, an ornamental element removably mounted on each arm, each of said ornamental elements having a shape and configuration corresponding to the arm on which it is mounted and having a designated coloration for complimenting the color of accessories as worn by the wearer, an opening formed in each ornamental element adjacent to an end thereof, and a projecting tab formed on each ornamental element at the end thereof opposite to said opening, each of said arms being defined by spaced apart curved rails that are formed in a one-piece construction, the rails terminating in ends that are fixed in said hinge assembly, the spacing of said rails forming a space into which an ornamental element is received, said hinge assembly including extensions that extend between the spaced apart rails, a pin fixed to each extension of said hinge assembly between said rails and being received in the opening of an ornamental element for mounting the adjacent end of the ornamental element on an arm, and a recess formed in each arm in the end opposite to the hinged end thereof for receiving a tab of an ornamental element therein for removably mounting the opposite end of said ornamental element on an arm, each of said ornamental elements being formed of a relatively thin material that provides for flexing movement thereof, wherein said ornamental elements are flexed into location on said arms, said flexing movement permitting the insertion of each pin as formed on said hinge assembly through the opening as formed in each ornamental element while the tab as formed thereon is inserted into the recess formed in the corresponding arm, the rails of each of said arms generally forming a curved "U"-shaped configuration, the recess as formed in each arm being located in the closed portion of the "U" and receiving the tab of an ornametnal element in removable snug-fitting relation therein.

2. A bracelet construction as claimed in claim 1, the opening as formed in an end of each ornamental element being slotted in configuration to enable said ornamental element to have relative movement with respect to the pin extending into said opening, thereby providing for convenient mounting of said ornamental elements on said arms and for the removal therefrom.

3. A bracelet construction as claimed in claim 1, said arms being identically formed in construction, and said ornamental elements also being identically constructed for insertion on either of said arms.

* * * * *